US005326528A

United States Patent [19]

Makino et al.

[11] Patent Number: 5,326,528

[45] Date of Patent: Jul. 5, 1994

[54] MAGNESIUM ALLOY

[75] Inventors: Kunihiko Makino, Yamaguchi; Noboru Miyamoto; Kyosuke Kanemitsu, both of Tokyo, all of Japan

[73] Assignee: Ube Industries, Ltd., Yamagushi, Japan

[21] Appl. No.: 3,644

[22] Filed: Jan. 13, 1993

[30] Foreign Application Priority Data

Jan. 14, 1992 [JP] Japan ..... 4-040053

[51] Int. Cl.[5] ..... C22C 23/04

[52] U.S. Cl. ..... 420/411; 420/405; 420/412; 420/413; 148/420

[58] Field of Search ..... 420/405, 411, 412, 413; 148/420

[56] References Cited

U.S. PATENT DOCUMENTS 3,094,413 6/1963 Fisher et al. ..... 420/413

*Primary Examiner*—R. Dean
*Assistant Examiner*—Robert R. Koehler
*Attorney, Agent, or Firm*—McAulay Fisher Nissen Goldberg & Kiel

[57] ABSTRACT

A magnesium alloy comprises magnesium, zinc in the amount of 4.0 to 15.0 weight % and silicon in the amount of 0.5 to 3.0 weight %, the weight % being based on the total amount of the alloy. The magnesium alloy further may contain manganese in the range of 0.2 to 0.4 weight %, beryllium in the range of 5 to 20 ppm by weight or rare earth metals in the range of 0.1 to 0.6 weight.

8 Claims, No Drawings

MAGNESIUM ALLOY

BACKGROUND OF THE INVENTION

1. Field of Invention

The present invention relates to a magnesium alloy suitably employable as materials of machine components to be used at high temperatures. Particularly, the invention relates to a heat resistant magnesium alloy appropriately employable as materials of engine components such as engine blocks (cylinder heads and cylinder block) and a transmission case of an automobile.

2. Description of Prior Art

Automobile industry has intended to use light-weight materials in place of iron and steel materials for manufacturing automobiles, in order to reduce the weight of the automobiles. As light-weight heat resistant alloys for engine components such as cylinder blocks and transmission cases which are machine components to be subjected to high temperatures, aluminum alloys (e.g., JIS ADC12 alloys) have been known.

Recently, the need of using light-weight materials for the engine components has further increased. Magnesium alloys have low specific gravity of about 1.8, which is less than that of the aluminum alloys (s.g.=approx. 2.7), and have various excellent characteristics. Therefore, the magnesium alloy are given much attention.

As magnesium alloys for materials of machine components, there have been known alloys of two different types, i.e., one type mainly containing aluminum (Al) (in the amount of about 4 to 10 weight %), and another type mainly containing Zn (in the amount of about 2 to 7 weight %, containing no aluminum). Some of such alloys are employed as heat resistant magnesium alloys for materials of machine components to be subjected to high temperatures. For examples, there have been known alloys such as ZE41A defined by ASTM and AE42 defined by DOW Standard.

The alloy ZE41A of ASTM is composed of 3.5 to 5.0 weight % zinc (Zn), 0.7 5 to 1.7 5 weight % rare earth metals (R.E.), 0.15 weight % or less manganese (Mn), 0.1 weight % or less copper (Cu), 0.01 weight % or less nickel (Ni), 0.3 weight % or less others and magnesium (Mg) of the remaining amount. The alloy AE42 of DOW Standard is composed of 3.5 to 4.5 weight % aluminium (A1), 2.0 to 3.0 weight % R.E., 0.27 weight % or less Mn, 0.20 weight % or less Zn, 0.04 weight % or less Cu, 0.004 weight % or less Ni, 0.004 weight % or less iron (Fe), 0.0004 to 0.001 weight % beryllium (Be), 0.01 weight % or less others and Mg of the remaining amount.

As R.E. (rare earth metals) incorporated into the above alloys, the misch-metal is generally employed. The representative composition of the misch-metal consists of 52 weight % cerium (Ce), 18 weight % neodymium (Nd), 5 weight % praseodymium (Pt), 1 weight % samarium (Sin) and 24 weight % lanthanum (La) and others.

The incorporation of R.E. is generally made to increase strength of the alloy at high temperatures. The R.E., however, is expensive so that the incorporation of R.E. into the alloy results in increase of cost for preparation of the magnesium alloy.

Further, in the case that the heat resistant magnesium alloys (ZE41A and AE42) containing R.E. is utilized for engine components such as engine blocks and transmission cases, the resultant components sometimes do not satisfy practical creep strength (minimum creep rate) and tensile strength at high temperatures which are required for the above engine components require.

SUMMARY OF THE INVENTION

In the case that the heat resistant magnesium alloy is used for the above engine components such as a cylinder head and a cylinder block, the alloy are placed not only in the atmosphere of high temperatures but also under high pressures within an engine room. Therefore, the alloy to be used for engine components are required to have high creep strength at high temperatures and high tensile strengths at room temperature as well as at high temperatures.

Thus, the present inventors have studied a composition of magnesium alloy to obtain a heat resistant magnesium alloy showing high creep strength at high temperatures and high tensile strengths at room temperature as well as at high temperatures. The incorporation of Zn into Mg gives to the resulting Mg alloy improved heat resistance via formation of Mg-Zn compound. The study of the inventors has revealed that the desired heat resistant magnesium alloy is obtained by further incorporation of Si (0.5 to 3.0 weight %) into a composition comprising Mg and Zn (with no Al ). The addition of Al reduces creep strength at high temperatures, so that Al is not used in the alloy. Incorporation of Si (0.5 to 3.0 weight %) gives the appropriate amount of eutectic crystal of $Mg_2Si$ to the alloy, whereby tensile strengths at room temperature and high temperatures and creep strength at high temperatures are enhanced. Further, it has been also revealed that the addition of R.E. to the above alloy improves anticorrosion property.

An object of the present invention is to provide a magnesium alloy showing high creep strength (decreased minimum creep rate) at high temperatures and high tensile strengths at room and high temperatures.

Another object of the invention is to provide a magnesium alloy showing improved anticorrosion property.

A further object of the invention is to provide a magnesium alloy which can be prepared at low cost.

The present invention resides in a magnesium alloy comprising magnesium, zinc in the amount of 4.0 to 15.0 weight % (preferably 4.0 to 7.0 weight %) and silicon in the amount of 0.5 to 3.0 weight % (preferably 0.5 to 1.5 weight %), said weight % being based on the total amount of the alloy.

Preferred embodiments of the above magnesium alloy are as follows:

(1) The magnesium alloy wherein manganese is further contained in the amount of 0.2 to 0.4 weight % based on the total amount of the alloy.

(2) The magnesium alloy wherein beryllium is further contained in the amount of 5 to 20 ppm by weight based on the total amount of the alloy.

(3) The magnesium alloy wherein rare earth metals are further contained in the amount of 0.1 to 0.6 weight % based on the total amount of the alloy.

The magnesium alloy of the invention which contains zinc and silicon in the above specific amounts shows high creep strength (decreased minimum creep rate) at high temperatures and high tensile strengths at room temperature as well as high temperatures. The magnesium alloy of the invention, which contains essentially no Al acquires the above characteristics without using R.E. which is costly material. In more detail, the magnesium alloy contains no rare earth metals, or contains the metals only in a little amount (not more than 0.6 weight %), so that the alloy can be produced at low preparation cost. Hence, the magnesium alloy of the invention can be advantageously employed as materials of engine components such as engine blocks (cylinder head and cylinder block) and a transmission case of an automobile.

Preferably, the heat resistant magnesium alloy further contains rare earth metals in the range of 0.1 to 0.6 weight % for improving anticorrosion property.

DETAILED DESCRIPTION OF THE INVENTION

The heat resistant magnesium alloy according to the invention comprises magnesium, zinc in the amount of 4.0 to 15.0 weight % and silicon in the amount of 0.5 to 3.0 weight % (the weight % is based on the total amount of the magnesium alloy). Rare earth metals, manganese and/or beryllium can be incorporated in the magnesium alloy.

The magnesium alloy of the invention contains zinc (Zn) in the amount of 4.0 to 15.0 weight %. Tensile strengths at room temperature and high temperatures of the magnesium alloy are enhanced with increase of content of Zn. If Zn is incorporated in the amount of more than 15.0 weight % into the magnesium alloy, the resultant magnesium alloy becomes brittle so that its tensile strengths at room temperature and high temperatures decreases. If Zn content is below 4.0 weight %, tensile strengths at room temperature and high temperatures and load at the 0.2 % proof stress are reduced.

The magnesium alloy of the invention contains silicon (Si) in the range of 0.5 to 3.0 weight %. If Si is incorporated in the amount of less than 0.5 weight % into the magnesium alloy, the crystallization of eutectic crystal of $Mg_2Si$ is reduced, so that tensile strengths at high temperatures and room temperature and creep strength at high temperatures become low. If Si content is not less than 0.5 weight %, the amount of eutectic crystals of $Mg_2Si$ increases with increase of Si. Accordingly, the resultant alloy is enhanced in tensile strengths at high temperatures and room temperature and creep strength at high temperatures. However, the incorporation of Si of more than 3.0 weight % results in increase of liquidus line-temperature of the resistant alloy so that handling of the molten metal (the alloy) is rendered difficult.

The reason why the magnesium alloy of the invention shows high creep strength (decreased minimum creep rate) at high temperatures and high tensile strength at room temperature and high temperatures, is thought as follows:

In the magnesium alloy containing Zn and Si, the $Mg_2Si$ or a combination of the $Mg_2Si$ and deposited MgZn is dispersed throughout the matrix of the magnesium alloy. The dispersed $Mg_2Si$ (or combination of $Mg_2Si$ and MgZn) inhibits the slip caused between crystal grains and grain boundaries, whereby its creep strength and tensile strength increases.

The magnesium alloy containing Zn and Si of the invention preferably further contains rare earth metals (R.E.) in the amount of 0.1 to 0.6 weight % (preferably 0.1 to 0.5 weight %). Rare earth metals employed in the invention may have any compositions. Examples of R.E include cerium (Ce), neodymium (Nd), praseodymium (Pt), samarium (Sm) lanthanum (La), gadolinium (Gd) and terbium (Tb). It is preferred to use as R.E. a material comprising mainly Ce and Nd. Examples of materials of R.E. include the mischmetal and Didymium-Metal containing 70 weight % of Nd (most of the remainder is Pr). The representative composition of the misch-metal consists of 52 weight % Ce, 18 weight % Nd, 5 weight % Pt, 1 weight % Sm and 24 weight % La and others.

In the case that R.E. is incorporated in the amount of less than 0.1 weight % into the magnesium alloy, anticorrosion property is not improved. Incorporation of R.E. of above 0.6 weight % may bring about separation of R.E. from the magnesium alloy. Addition of R.E. is so far made in order to improve heat resistance. In the invention, addition of Si to the magnesium alloy containing Zn enables to enhance heat resistance, whereas addition of R.E. enables improvement of anticorrosion property. In more detail, R.E. is incorporated into the matrix (the alloy) to form a solid solution whereby variation of electric potential of the alloy occurs. The variation is thought to improve anticorrosion property.

The magnesium alloy containing Zn and Si of the invention preferably further contains manganese (Mn) in the amount of 0.2 to 0.4 weight % based on the total amount of the magnesium alloy. In the case that Mn is incorporated in the amount of less than not 0.2 weight % into the magnesium alloy, anticorrosion property is improved. If Mn is incorporated in the amount of more than 0.4 weight % into the magnesium alloy, crystallization of Mn in the alloy is developed to reduce tensile strength.

The magnesium alloy containing Zn and Si of the invention preferably further contains beryllium (Be) in the amount of 5 to 20 ppm by weight based on the total amount of the magnesium alloy. The magnesium alloy containing Be of not less than 5 ppm is capable of preventing combustion of the molten metal (the alloy). However, if the content exceeds 20 ppm, size of crystal grain of Be increases and therefore lowers tensile strength of the resultant alloy.

The magnesium alloy of the invention is preferred to consist essentially of above Zn and Si and at least two kinds of material elements selected from the group consisting of manganese in the amount of 0.2 to 0.4 weight %, beryllium in the amount of 5 to 20 ppm by weight and rare earth metals in the amount of 0.1 to 0.6 weight %. All the weight % are based on the total amount of the magnesium alloy.

The magnesium alloy of the invention may contain unavoidable impurity in a small amount (e.g., in the amount of not more than 0.01 weight %). The unavoidable impurity includes, for instance, Fe, Ni, Cu and Cl. These elements may be contained in a magnesium metal and other additional metals and elements which are used as materials for the preparation of the alloy.

The magnesium alloy of the invention contains essentially no Al as mentioned above, but may contain in the range of not more than 1 weight % based on the total amount of the alloy.

The heat resistant magnesium alloy of the invention as described above has the following characteristics.

In a metal casting, minimum creep rate (which represents the creep strength) under loading stress of 30 MPa (at 150° C.) is not more than $2.7\times10^{-4}$%/hour, tensile strength at room temperature is not less than 212 MPa, load at 0.2 % proof stress at room temperature is not less than 130 MPa, tensile strength at 150° C. is not less than 166 MPa and load at 0.2% proof stress at 150° C. is not less than 118 MPa.

In a die casting, minimum creep rate under loading stress of 30 MPa (at 150° C.) is not more than $3.3\times10^{-4}$ %/hour, tensile strength at room temperature is not less than 227 MPa, load at 0.2% proof stress at room temperature is not less than 140 MPa, tensile strength at 150° C. is not less than 169 MPa and load at 0.2% proof stress at 0° C. is not less than 121 MPa.

In a metal casting, the amount decreased by corrosion that is measured by the neutral salt spray test of 48 hours is not more than 0.94 mg/cm$^2$.day.

The present invention is further described by the following Examples and Comparison Examples.

EXAMPLES 1 TO 54 AND COMPARISON EXAMPLES 1 to 12

Materials of each of alloy compositions shown in Tables 1 to 3 were melted in the atmosphere of hexafluorosulfide gas to prepare an alloy. Similarly, all alloys shown in Tables 1 to 3 were prepared.

The alloy composition used in Comparison Example 6 corresponds to that of ASTM ZE41A.

The alloy composition used in Comparison Example 12 corresponds to that of AE42 of DAW Standard.

Each of the obtained alloys was poured in a metal mold for preparing a test piece (according to JIS H5203) at 700° C., and was subjected to heat treatments in a combination of a warm-water solution treatment comprising holding 320° C. for 24 hours and quenching to 90° C. and an age hardening by air cooling at 190° C. for 20 hours. Similarly, all test pieces of metal casting were prepared.

In preparation of a test piece in Comparison Example 6, as a heat treatment, an age hardening by air cooling at 180° C. for 16 hours was carried out instead of that at 180° C. for 16 hours.

Separately, each of the alloys was casted and pressed using a die casting machine to prepare a plate-like casting having size of 100 mm×200 mm×4 mm (thickness). Similarly, all test pieces of die casting were prepared. These test pieces were subjected to no heat treatment.

TABLE 1

| Metal Casting | Die casting | Alloy Composition (weight %) Zn | Si | Mg |
|---|---|---|---|---|
| Example 1 | Example 16 | 4.1 | 1.1 | remainder |
| Example 2 | Example 17 | 5.0 | 1.0 | remainder |
| Example 3 | Example 18 | 6.1 | 1.0 | remainder |
| Example 4 | Example 19 | 7.0 | 1.1 | remainder |
| Example 5 | Example 20 | 4.0 | 0.6 | remainder |
| Example 6 | Example 21 | 5.1 | 0.5 | remainder |
| Example 7 | Example 22 | 6.1 | 0.5 | remainder |
| Example 8 | Example 23 | 6.9 | 0.6 | remainder |
| Example 9 | Example 24 | 4.0 | 1.5 | remainder |
| Example 10 | Example 25 | 5.5 | 1.5 | remainder |
| Example 11 | Example 26 | 6.1 | 1.5 | remainder |
| Example 12 | Example 27 | 7.0 | 1.4 | remainder |
| Com. Ex. 1 | Com. Ex. 7 | 3.0 | 1.1 | remainder |
| Com. Ex. 2 | Com. Ex. 8 | 15.9 | 1.0 | remainder |
| Com. Ex. 3 | Com. Ex. 9 | 20.0 | 1.0 | remainder |
| Com. Ex. 4 | Com. Ex. 10 | 6.1 | 0.2 | remainder |
| Com. Ex. 5 | Com. Ex. 11 | 5.9 | 3.5 | remainder |
| Com. Ex. 6 | — | (Zn: 4.2, R.E.: 1.3, Zr: 0.6, Mn: 0.14, Mg: remainder) | | |
| — | Com. Ex. 12 | (Al: 4.0, R.E.: 2.1, Mn: 0.29, Mg: remainder) | | |

TABLE 2

| Metal Casting | Die Casting | Alloy Composition (weight %) Zn | Si | Mn | Be* | Mg |
|---|---|---|---|---|---|---|
| Example 13 | Example 28 | 6.1 | 1.0 | 0.30 | — | remainder |
| Example 14 | Example 29 | 6.0 | 1.0 | — | 10 | remainder |

TABLE 2-continued

| Metal Casting | Die Casting | Alloy Composition (weight %) Zn | Si | Mn | Be* | Mg |
|---|---|---|---|---|---|---|
| Example 15 | Example 30 | 6.2 | 1.1 | 0.35 | 12 | remainder |

Note: Unit of Be is ppm by weight.

TABLE 3

| Metal Casting | Die casting | Alloy Composition (weight %) Zn | Si | Mg |
|---|---|---|---|---|
| Example 31 | Example 43 | 7.0 | 1.5 | remainder |
| Example 32 | Example 44 | 9.1 | 1.0 | remainder |
| Example 33 | Example 45 | 14.0 | 1.9 | remainder |
| Example 34 | Example 46 | 6.1 | 0.8 | remainder |
| Example 35 | Example 47 | 10.1 | 0.5 | remainder |
| Example 36 | Example 48 | 13.9 | 0.9 | remainder |
| Example 37 | Example 49 | 6.0 | 2.3 | remainder |
| Example 38 | Example 50 | 8.5 | 3.0 | remainder |
| Example 39 | Example 51 | 11.1 | 2.0 | remainder |
| Example 40 | Example 52 | 15.0 | 2.4 | remainder |
| Example 41 | Example 53 | 4.1 | 1.2 | remainder |
| Example 42 | Example 54 | 4.0 | 0.7 | remainder |

The obtained test pieces were evaluated in the following manner.

(1) CREEP TEST

The creep test was carried out according to JIS Z2271. The test piece was fixed to a measuring apparatus and heated for 1 hour or more to reach 150° C. The test piece was further heated to keep the temperature of 150° C. for 16 to 24 hours. Elongation of the test piece was measured under load stress 30 MPa at 150° C. with the elapse of time to give a creep curve, whereby the minimum creep rate was calculated.

(2) TENSILE TEST

The tensile test was carried out according to JIS Z2241. Maximum tensile load was measured at room temperature and at 150° C. Each of the obtained values was divided by a section area of the test piece to give tensile strength.

Load when permanent elongation occurred was measured at room temperature and at 150° C. The obtained value was divided by a section area of the test piece to give load at 0.2 % proof stress.

The measured results of the metal castings are set forth in Table 4.

TABLE 4

| | Minimum Creep Rate ($\times10^{-4}$ %/hour) | Tensile Strength (MPa) Room Temp. Tensile Strength | Room Temp. 0.2% Proof Stress | 150° C. Tensile Strength | 150° C. 0.2% Proof Stress |
|---|---|---|---|---|---|
| Example 1 | 2.7 | 212 | 148 | 170 | 121 |
| Example 2 | 2.2 | 215 | 141 | 171 | 125 |
| Example 3 | 2.2 | 251 | 152 | 168 | 118 |
| Example 4 | 2.1 | 265 | 162 | 169 | 119 |
| Example 5 | 2.0 | 224 | 130 | 172 | 126 |
| Example 6 | 2.5 | 226 | 141 | 171 | 120 |
| Example 7 | 2.2 | 248 | 146 | 175 | 123 |
| Example 8 | 1.9 | 244 | 145 | 168 | 128 |
| Example 9 | 2.0 | 223 | 134 | 173 | 125 |
| Example 10 | 2.4 | 227 | 130 | 166 | 122 |
| Example 11 | 1.9 | 241 | 142 | 169 | 119 |
| Example 12 | 1.8 | 230 | 148 | 173 | 125 |
| Example 13 | 2.2 | 224 | 128 | 170 | 125 |
| Example 14 | 2.0 | 237 | 140 | 173 | 129 |
| Example 15 | 2.3 | 250 | 151 | 169 | 121 |
| Example 31 | 2.0 | 225 | 151 | 173 | 120 |
| Example 32 | 2.1 | 264 | 162 | 178 | 124 |
| Example 33 | 2.6 | 285 | 173 | 189 | 129 |

TABLE 4-continued

| | Minimum Creep Rate (× $10^{-4}$ %/hour) | Tensile Strength (MPa) Room Temp. Tensile Strength | Room Temp. 0.2% Proof Stress | 150° C. Tensile Strength | 150° C. 0.2% Proof Stress |
|---|---|---|---|---|---|
| Example 34 | 2.4 | 220 | 143 | 173 | 121 |
| Example 35 | 2.0 | 249 | 160 | 174 | 124 |
| Example 36 | 2.7 | 284 | 170 | 181 | 130 |
| Example 37 | 2.3 | 222 | 134 | 173 | 121 |
| Example 38 | 1.9 | 233 | 145 | 173 | 124 |
| Example 39 | 2.0 | 257 | 163 | 175 | 129 |
| Example 40 | 2.3 | 290 | 175 | 182 | 135 |
| Example 41 | 2.0 | 212 | 138 | 170 | 118 |
| Example 42 | 2.2 | 214 | 130 | 166 | 119 |
| Com. Ex. 1 | 3.7 | 185 | 53 | 119 | 52 |
| Com. Ex. 2 | 4.7 | 210 | 128 | 163 | 115 |
| Com. Ex. 3 | 5.6 | 171 | 119 | 121 | 73 |
| Com. Ex. 4 | 4.3 | 180 | 98 | 130 | 82 |
| Com. Ex. 5 | 3.0 | 190 | 122 | 132 | 98 |
| Com. Ex. 6 | 2.8 | 205 | 125 | 165 | 116 |

The measured results of the die castings are set forth in Table 5.

TABLE 5

| | Minimum Creep Rate (× $10^{-4}$ %/hour) | Room Temp. Tensile Strength | Room Temp. 0.2% Proof Stress | 150° C. Tensile Strength | 150° C. 0.2% Proof Stress |
|---|---|---|---|---|---|
| Example 16 | 2.2 | 230 | 141 | 178 | 129 |
| Example 17 | 2.8 | 241 | 145 | 171 | 126 |
| Example 18 | 2.9 | 255 | 150 | 169 | 121 |
| Example 19 | 3.1 | 251 | 149 | 175 | 130 |
| Example 20 | 3.0 | 227 | 140 | 172 | 125 |
| Example 21 | 3.2 | 248 | 148 | 173 | 125 |
| Example 22 | 3.0 | 250 | 147 | 178 | 134 |
| Example 23 | 2.9 | 248 | 146 | 170 | 122 |
| Example 24 | 3.3 | 240 | 145 | 175 | 131 |
| Example 25 | 2.4 | 246 | 149 | 170 | 130 |
| Example 26 | 2.9 | 245 | 143 | 172 | 133 |
| Example 27 | 2.8 | 240 | 142 | 176 | 139 |
| Example 28 | 3.0 | 255 | 149 | 170 | 123 |
| Example 29 | 3.2 | 248 | 145 | 172 | 121 |
| Example 30 | 2.8 | 240 | 142 | 170 | 122 |
| Example 43 | 2.2 | 240 | 142 | 172 | 125 |
| Example 44 | 2.7 | 243 | 143 | 172 | 131 |
| Example 45 | 3.3 | 250 | 148 | 176 | 140 |
| Example 46 | 2.4 | 238 | 142 | 172 | 129 |
| Example 47 | 2.9 | 240 | 145 | 174 | 132 |
| Example 48 | 3.1 | 249 | 147 | 176 | 135 |
| Example 49 | 2.4 | 233 | 141 | 173 | 126 |
| Example 50 | 2.2 | 241 | 143 | 173 | 130 |
| Example 51 | 2.3 | 244 | 144 | 175 | 132 |
| Example 52 | 3.0 | 255 | 150 | 178 | 138 |
| Example 53 | 2.5 | 230 | 141 | 169 | 121 |
| Example 54 | 2.8 | 227 | 140 | 170 | 123 |
| Com. Ex. 7 | 4.8 | 210 | 89 | 140 | 70 |
| Com. Ex. 8 | 8.1 | 225 | 138 | 165 | 118 |
| Com. Ex. 9 | 9.8 | 205 | 120 | 141 | 111 |
| Com. Ex. 10 | 8.9 | 189 | 131 | 145 | 128 |
| Com. Ex. 11 | 7.2 | 210 | 139 | 151 | 116 |
| Com. Ex. 12 | 3.8 | 226 | 137 | 156 | 112 |

As is apparent from Tables 1 to 5, both the metal castings and the die castings obtained by Examples exhibit enhanced tensile strength and enhanced load at 0.2% proof stress, as compared with any castings obtained by Comparison Examples. Further, with respect of minimum creep rate, castings obtained by Examples show reduced rate or the same rate, as compared with those obtained by Comparison Examples.

EXAMPLES 55 TO 66 and COMPARISON EXAMPLES 13

Materials of each of alloy compositions shown in Table 6 was melted in the atmosphere of hexafluorosulfide gas to prepare an alloy. Similarly, all alloys shown in Table 6 were prepared.

An alloy composition used in Comparison Example 13 corresponds to that of ASTM ZE41A and is the same as Comparison Example 6.

Each of the obtained alloys was poured in a metal mold for preparing test piece having size of 100 mm×70 mm×15 mm (thickness) at 700° C., and was subjected to heat treatments in a combination of a warm-water solution treatment comprising holding 320° C. for 24 hours and quenching to 90° C. and an age hardening by air cooling at 190° C. for 20 hours. Similarly, all test pieces of metal casting were prepared.

TABLE 6

| Metal Casting | Alloy Composition (weight %) Zn | Si | R.E.* | Mn | Be** | Zr | Mg |
|---|---|---|---|---|---|---|---|
| Example 55 | 6.2 | 0.8 | 0.20 | — | — | — | remainder |
| Example 56 | 5.3 | 1.2 | 0.13 | — | — | — | remainder |
| Example 57 | 6.9 | 1.3 | 0.45 | — | — | — | remainder |
| Example 58 | 4.5 | 0.9 | 0.31 | 0.23 | — | — | remainder |
| Example 59 | 6.0 | 1.0 | 0.23 | — | 13 | — | remainder |
| Example 60 | 5.9 | 1.1 | 0.30 | 0.31 | 11 | — | remainder |
| Example 61 | 6.2 | 1.1 | — | — | — | — | remainder |
| Example 62 | 6.0 | 1.2 | — | 0.23 | 10 | — | remainder |
| Example 63 | 5.9 | 1.0 | 0.05 | — | — | — | remainder |
| Example 64 | 6.1 | 0.8 | 0.04 | 0.28 | 15 | — | remainder |
| Example 65 | 5.8 | 1.0 | 0.55 | — | — | — | remainder |
| Example 66 | 6.5 | 1.2 | 0.60 | 0.30 | 12 | — | remainder |
| Com. Ex. 13 | 4.2 | — | 1.3 | 0.14 | — | 0.6 | remainder |

Note: R.E. (rare earth metals) uses misch metal.
Note: Unit of Be is ppm by weight.

The obtained test pieces were evaluated in the following manner.

(1) CREEP TEST

The creep test was carried out in the same manner as mentioned hereinbefore (according to JIS Z2271).

(2) TENSILE TEST

The tensile test and load at 0.2 % proof stress were carried out in the same manner as mentioned hereinbefore (according to JIS Z2241).

(3) Neutral salt spray test

The neutral salt spray test was carried out according to JIS Z2371. The test piece was placed at 20±50 to the , vertical line. NaCl solution (concentration=5±0.5%, s.g.=1.0259 to 1.0329, pH=6.5 to 7.2 at 35° C.) was sprayed onto the test piece for 48 hours. The weight of the resultant test piece was measured, and the amount decreased by corrosion was calculated.

The measured results of the metal castings are set forth in Table 7.

TABLE 7

| | Decrease in Corrosion (mg/cm$^2$ · day) | Minimum Creep Rate ($\times 10^{-4}$ %/hour) | Tensile Strength (MPa) Room Temp. Tensile Strength | Room Temp. 0.2 Proof Stress | 150° C. Tensile Strength | 150° C. 0.2% Proof Stress |
|---|---|---|---|---|---|---|
| Example 55 | 0.92 | 2.6 | 233 | 142 | 170 | 120 |
| Example 56 | 0.85 | 2.1 | 252 | 159 | 168 | 129 |
| Example 57 | 0.94 | 2.5 | 231 | 147 | 169 | 123 |
| Example 58 | 0.93 | 2.4 | 260 | 150 | 177 | 125 |
| Example 59 | 0.91 | 2.0 | 248 | 138 | 171 | 120 |
| Example 60 | 0.84 | 1.9 | 253 | 161 | 174 | 128 |
| Example 61 | 5.66 | 2.2 | 250 | 156 | 167 | 123 |
| Example 62 | 5.01 | 2.5 | 244 | 143 | 173 | 122 |
| Example 63 | 4.78 | 2.3 | 236 | 152 | 169 | 119 |
| Example 64 | 4.90 | 2.0 | 255 | 168 | 175 | 120 |
| Example 65 | 0.90 | 1.9 | 242 | 139 | 172 | 127 |
| Example 66 | 0.86 | 2.4 | 229 | 149 | 172 | 123 |
| Com. Ex. 13 | 5.48 | 2.8 | 205 | 125 | 165 | 116 |

As is apparent from Tables 6 and 7, the metal castings obtained by Examples 55 to 60 and 65 to 66 exhibit not only enhanced tensile strength but also improved anticorrosion property, as compared with that obtained by Comparison Example 13. On the other hand, the metal castings obtained by Examples 61 to 64, which contain no R.E. (rare earth metals), exhibit enhanced tensile strength and anticorrosion property at the conventional level.

What is claimed is:

1. A magnesium alloy consisting essentially of zinc in the amount of 4.0 to 15.0 weight %, silicon in the amount of 0.5 to 3.0 weight %, the remainder being magnesium.

2. A magnesium alloy consisting essentially of zinc in the amount of 4.0 to 15.0 weight %, silicon in the amount of 0.5 to 3.0 weight %, manganese in the amount of 0.2 to 0.4 weight %, the remainder being magnesium.

3. A magnesium alloy consisting essentially of zinc in the amount o f 4.0 to 15.0 weight %, silicon in the amount of 0.5 to 3.0 weight %, beryllium in the amount o 5 to 20 ppm, the remainder being magnesium.

4. A magnesium alloy consisting essentially of zinc in the amount of 4.0 to 15.0 weight %, silicon in the amount of 0.5 to 3.0 weight %, manganese in the amount of 0.2 to 0.4 weight %, beryllium in the amount of 5 to 20 ppm, the remainder being magnesium.

5. A magnesium alloy consisting essentially of zinc in the amount of 4.0 to 15.0 weight %, silicon in the amount of 0.5 to 3.0 weight %, rare earth metals in the amount of 0.1 to 0.6 weight %, the remainder being magnesium.

6. A magnesium alloy consisting essentially of zinc in the amount of 4.0 to 15.0 weight %, silicon in the amount of 0.5 to 3.0 weight %, rare earth metals in the amount of 0.1 to 0.6 weight %, manganese in the amount of 0.2 to 0.4 weight %, the remainder being magnesium.

7. A magnesium alloy consisting essentially of zinc in the amount of 4.0 to 15.0 weight %, silicon in the amount of 0.5 to 3.0 weight %, rare earth metals in the amount of 0.1 to 0.6 weight %, beryllium in the amount of 5 to 20 ppm, the remainder being magnesium.

8. A magnesium alloy consisting essentially of zinc in the amount of 4.0 to 15.0 weight %, silicon in the amount of 0.5 to 3.0 weight %, rare earth metals in the amount of 0.1 to 0.6 weight %, manganese in the amount of 0.2 to 0.4 weight %, beryllium in the amount of 5 to 20 ppm, the remainder being magnesium.

* * * * *